United States Patent [19]

Hackman

[11] 3,978,796

[45] Sept. 7, 1976

[54] FOCUSED BLAST-FRAGMENT WARHEAD

[75] Inventor: Emory E. Hackman, Arlington, Va.

[73] Assignee: The United States of America as represented by the Secretary of the Navy, Washington, D.C.

[22] Filed: Apr. 30, 1968

[21] Appl. No.: 725,546

[52] U.S. Cl. ..... 102/67; 102/56 SC

[51] Int. Cl.[2] ..... F42B 13/18; F42B 13/10

[58] Field of Search ..... 102/67, 56, 61, 5, 20, 102/24 HC, 23, DIG. 2

[56] References Cited

UNITED STATES PATENTS

| | | | |
|---|---|---|---|
| 2,831,429 | 4/1958 | Moore | 102/20 |
| 2,856,850 | 10/1958 | Church et al. | 102/24 HC |
| 2,972,949 | 2/1961 | MacLeod | 102/67 |
| 3,081,704 | 3/1963 | Boswell | 102/67 |
| 3,145,656 | 8/1964 | Cook et al. | 102/56 |
| 3,170,402 | 2/1965 | Morton et al. | 102/DIG. 2 |
| 3,326,125 | 6/1967 | Silvia et al. | 102/23 |

*Primary Examiner*—Charles T. Jordan

[57] ABSTRACT

The present invention relates to fragment projection-blast devices capable of focusing fragmentation and destructive blast effects. In particular, the invention takes the form of a warhead characterized by interior, multipoint initiation of detonation which increases metal velocity and enhances blast properties, a truncated cone charge and metal liner arrangement which controls metal projection direction and blast propagation, and end plates which partially confine gaseous products and enhance initial blast properties. According to the invention, an explosive composition is shaped by the projectile walls and by metal truncated cone arrangements on the warhead. Detonators located in the interior of the explosive compositon and opposite the apices of the truncated cones ignite simultaneously, causing directed fragmentation.

4 Claims, 2 Drawing Figures

EMORY E. HACKMAN
INVENTOR

J. O. Tresansky
ATTORNEY

FOCUSED BLAST-FRAGMENT WARHEAD

BACKGROUND OF THE INVENTION

A. Field of the Invention

The present invention relates to directed fragmentation warheads capable of controlling metal projection direction and capable of focusing destructive blast effects. More specifically, the device of the present invention incorporates a shaped charge contained within a metallic liner and gas-confining end plates with detonators situated within the charge and ignited simultaneously.

B. Description of the Prior Art

Prior art devices for directing a warhead blast generally involve scoring or otherwise weakening the warhead casing, thus allowing a preferentail rupture at the weakened area and thereby causing some amount of blast concentration in the vicinity proximate to the weakened area of the casing. Similar devices, such as that disclosed by Zapf in U.S. Pat. No. 3,000,309, involve charges shaped to form voids between the charge body and a containing shell. On detonation of the charge, shock waves strike the shell at differential increments of time, causing preferential fragmentation in the resulting shell burst.

Toglialatela discloses a directed fragmentation bomb comprising channels through which blast is directed to a stack of metal rings. On contact by the blast the rings are shattered and the resulting fragments scattered in the direction of the blast.

Although shaped charges and directed blast devices are seen to be well-known in the art, no prior device exhibits the distinctive characteristics of the present invention, particularly multipoint initiation of detonation within a cylindrical charge with truncated cone-shaped surfaces. The present device is thought to be, based on theory as well as observed results, an improved design which increases metal projection.

SUMMARY OF THE INVENTION

Focused-blast warheads find application to any number of environments, such as anti-installation or anti-personnel. The present invention, while satisfying the requirements of these applications, should prove especially useful in combination with a guided missile system as an anti-aircraft weapon. Focusing fragmentation and blast effects toward an unfriendly target increases the probability of scoring a direct hit on the object. The heart of such a weapons system would be a warhead capable of focusing destructive blast properties on command from concomitant target sensing apparatus.

The principal features of the subject invention include an interior multipoint initiator of detonation; a truncated cone surface arrangement on a cylindrical charge; and end plates for partially confining gaseous products and enhancing initial blast properties. Interior, multipoint initiation of detonation is utilized in lieu of double-ended or center initiation and provides increased metal velocity as well as enhancing blast effects. The truncated cone arrangement controls metal projection direction and blast propagation. Depending upon cone angles chosen and upon the form and material of the metal chosen, the device can be considered to be a fragment projection-blast device or a shaped charge device.

Accordingly, it is an object of the invention to provide a warhead capable of focusing blast effects.

It is also an object of the invention to provide a fragmentation warhead which increases metal projection in a desired direction and augments fragment velocity in that direction.

It is a further object of the invention to increase the effective range and reliability of the missile carrier by decreasing the occurrence of near misses.

Further objects and attendant advantages will become more readily apparent and more easily understood by reference to the following description of the preferred embodiment.

DESCRIPTION OF THE PREFERRED EMBODIMENTS

Figure 1:
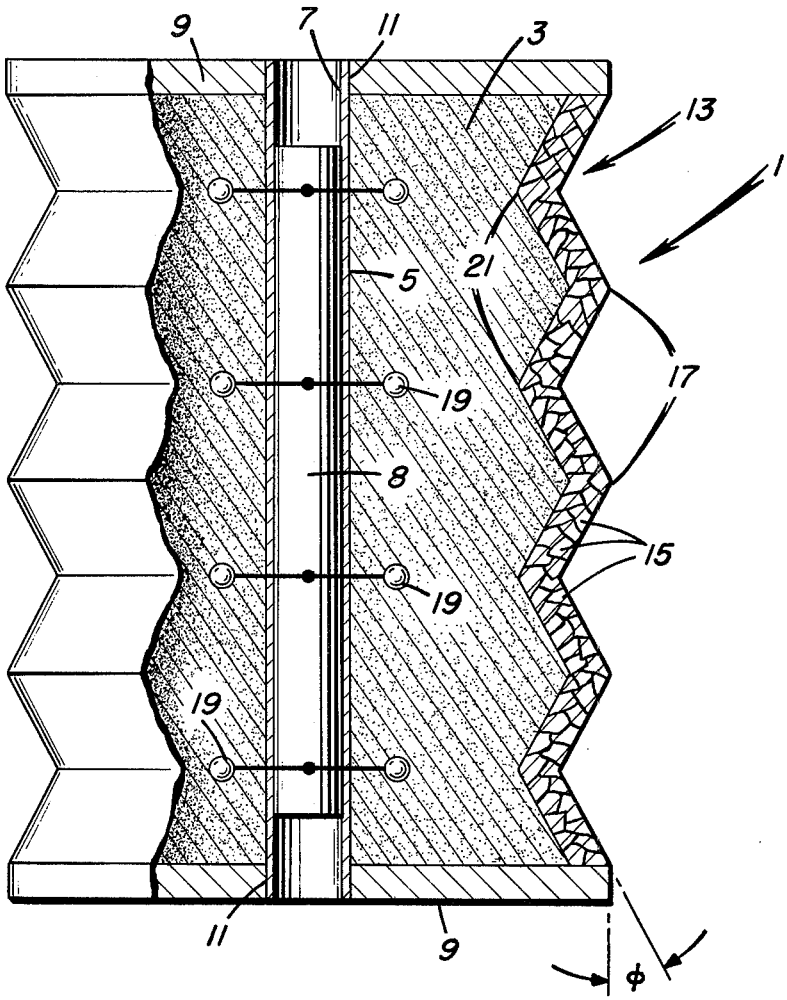
FIG. 1 is an axial section, partly in elevation, illustrating the invention, the detonators employed being shown schematically.

In FIG. 1, which shows the invention in partial section, a warhead of corrugated cylindrical shape is shown at 1 and has a cast explosive body 3. The explosive body 3 is formed with a centrally disposed cylindrical channel 5 extending throughout the length of the warhead 1. Disposed within the channel 5 is a cylindrical steel liner 7 the wall of which is preferably of 0.05 inch thickness.

A standard arming device 8 is located within the cylindrical liner 7 and is joined by well-known means to detonation initiators which will be hereinafter described.

The warhead 1 has relatively thick circular end plates 9 which abut the explosive body 3 at its opposite ends and which have bores 11 which receive the ends of the steel liner 7.

The body 3 of the warhead 1 is comprised of a projectile consisting of a layer 13 of fragments 15. The layer 13 has its opposite ends connected to the end plates 9 at their outer perimeters, thus enclosing the explosive body 3.

The surface of the warhead 1 can be further described as comprising radially extending corrugations 17 regularly disposed on its surface. The corrugations 17 could be likened to truncated cones where the angle $\phi$ made by a perpendicular to an end plate 9 with the slope of a surface of the corrugations 17 is dictated by well-known theory to be 18°.

Detonators 19, arranged interiorly of the explosive body 3 and opposite troughs 21 of the corrugations 17, provide multipoint initiation of detonation. Explosive initiation may be effected by a number of well-known means, such means not being pertinent to the invention.

The principal features of the design shown in FIG. 1 are: (1) interior, multipoint initiation of detonation as represented by detonators 19 which provide increased metal velocity and enhanced blast properties, (2) a truncated conical arrangement as found in the corrugations 17 which control metal projection direction and blast propagation, and (3) partial confinement of gaseous products by the end plates 9 which confinement enhances initial blast properties.

The angle $\phi$ may be altered to control metal emission direction by taking into account the shape and angle of approach of the detonation wave front to the metal layer-explosive material interface, detonation wave interaction, and certain other factors which may alter metal velocities and resultant distribution at distances from the exploded warhead.

Figure 2:
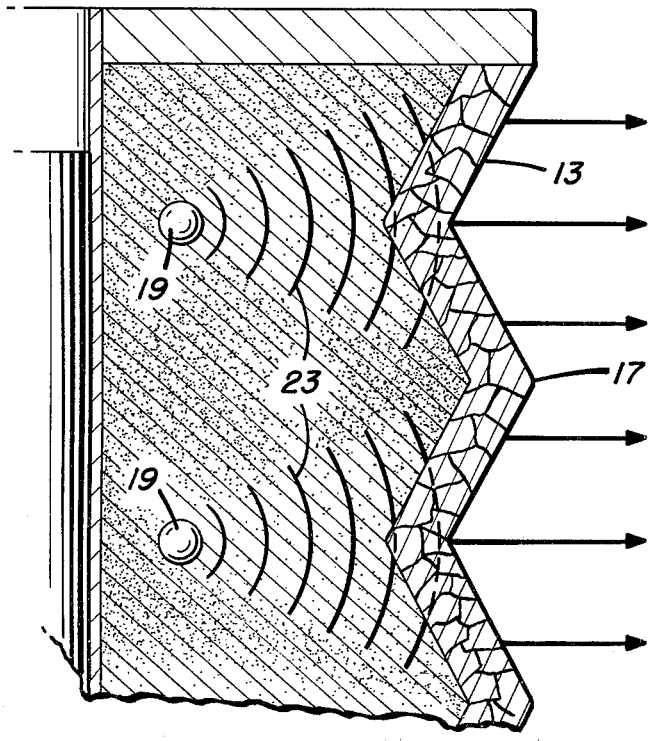
FIG. 2 is an enlarged detail sectional view showing a portion of one wall of the invention, and showing schematically two of the initiators and the detonation wave and fragmentation patterns produced upon detonation of said initiators.

FIG. 2 schematically depicts in a partial cross-section the pattern of detonation shock waves arising on detonation of the detonators 19. Referring to FIG. 2, detonation causes a radially advancing shock wave represented by arcuate lines 23 and originating at the detonators 19. When the wave strikes the angular surface of the corrugations 17, stresses acting on the fragmentation layer 13 are greater than the normal critical fracture stress of said layer, causing fragmentation of the layer in a direction perpendicular to the longitudinal axis of the warhead. Fragmentation and blast effects are thus focused in radial planes extending outwardly from the warhead.

I claim:

1. A fragmentation warhead exhibiting focused blast properties, comprising a body of explosive material having a generally cylindrical shape with annular conical corrugations radially and regularly disposed over its surface, said corrugations defining troughs therebetween, a projectile surrounding the cylindrical corrugated surface of the body, said projectile having its surface conforming to the shape of the body surface, an axial channel disposed within the body, a liner mounted in the channel, point initiation detonators embedded in the body, one of the detonators being disposed in confronting relation to each of said troughs whereby, upon initiation of the detonators, explosive of the body will produce shock waves that will act on the walls of the corrugations for fragmenting the projectile and projecting the fragments thereof in a direction normal to the axis of the warhead, arming means mounted in the liner and connected to said detonators, and end plates secured to the liner and to the projectile at opposite ends of the body for closing the ends of said body, said end plates partially confining gaseous explosion products produced upon detonation of the body, explosion of the body producing a focused blast characterized by increased metal projection and enhanced blast properties.

2. A fragmentation warhead exhibiting focused blast properties, comprising a body formed of an explosive material, said body being generally cylindrical in shape, having conical corrugations radially and regularly disposed over its surface, said corrugations defining troughs therebetween, and having an axial channel formed in the body;

a liner mounted in the channel;

a projectile surrounding the cylindrical corrugated surface of the body, said projectile having its surface conforming to the shape of the body surface;

spaced point detonation means embedded in the body, and disposed to confront each of said troughs whereby, upon initiation of the detonation means, explosion of the body will produce shock waves that will act on the walls of the corrugations for fragmenting the projectile and projecting the fragments thereof in a direction normal to the axis of the warhead;

arming means mounted in the liner and connected to said detonation means; and means closing the ends of the body for partially confining gaseous explosion products produced upon detonation thereof, explosion of the body producing a focused blast characterized by increased metal projection and enhanced blast properties.

3. The invention as recited in claim 2, wherein said third mentioned means comprises end plates secured to the liner and to the projectile at opposite ends of the body.

4. The invention as recited in claim 2, wherein the projectile comprises a layer of fragments.

* * * * *